US008201349B2

(12) United States Patent
Kanzler et al.

(10) Patent No.: US 8,201,349 B2
(45) Date of Patent: Jun. 19, 2012

(54) PISTE GROOMING VEHICLE WITH CABLE TORQUE COMPENSATION

(75) Inventors: Helmut Kanzler, Voehringen (DE); Michael Kuhn, Achstetten (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 540 days.

(21) Appl. No.: 11/988,084

(22) PCT Filed: May 19, 2006

(86) PCT No.: PCT/EP2006/004762

§ 371 (c)(1),
(2), (4) Date: May 28, 2010

(87) PCT Pub. No.: WO2007/000216

PCT Pub. Date: Jan. 4, 2007

(65) Prior Publication Data

US 2010/0236107 A1 Sep. 23, 2010

(30) Foreign Application Priority Data

Jun. 27, 2005 (DE) ..... 10 2005 031 076

(51) Int. Cl.
*E01H 4/00* (2006.01)
*B66D 1/08* (2006.01)

(52) U.S. Cl. ..... 37/219; 254/361

(58) Field of Classification Search ..... 701/50, 701/213; 37/219, 220, 221, 266, 268, 270, 37/222–229; 166/53, 77.51, 77.1; 180/69.3, 180/165, 6.48, 7.5; 254/267, 323, 328, 361, 254/314, 315, 723

See application file for complete search history.

(56) References Cited

U.S. PATENT DOCUMENTS

| | | | | |
|---|---|---|---|---|
| 5,072,530 | A * | 12/1991 | Goller | 37/219 |
| 5,765,782 | A | 6/1998 | DeVettor | |
| 6,276,449 | B1 * | 8/2001 | Newman | 166/53 |
| 6,585,232 | B2 | 7/2003 | Rechenmacher et al. | |
| 7,165,758 | B2 | 1/2007 | Kanzler | |
| 7,299,569 | B2 | 11/2007 | Kanzler | |
| 2001/0017366 | A1 | 8/2001 | Rechenmacher | |
| 2002/0079145 | A1 * | 6/2002 | Kanzler et al. | 180/6.48 |
| 2002/0156574 | A1 * | 10/2002 | Fortin | 701/213 |
| 2004/0144000 | A1 | 7/2004 | Kanzler | |
| 2004/0173784 | A1 | 9/2004 | Kanzler | |

FOREIGN PATENT DOCUMENTS

DE 102 53 412 A1 5/2004

(Continued)

OTHER PUBLICATIONS

Official Action from the Germany Patent Office dated Oct. 9, 2006 (3 pages).
Notification of Transmittal of International Search Report dated Aug. 1, 2006 (2 pages).
International Search Report dated Aug. 1, 2006 (4 pages).

(Continued)

*Primary Examiner* — Robert Pezzuto
(74) *Attorney, Agent, or Firm* — Flynn, Thiel, Boutell & Tanis, P.C.

(57) ABSTRACT

The invention relates to a piste grooming vehicle with a point of application for cable forces that is associated with a cable winch, the point being at a distance from a yaw axis of the piste grooming machine, at least one control device being provided and being operatively connected to at least one control for automatically compensating at least one cable torque that can be applied by a cable traction force of the cable winch in relation to the yaw axis.

20 Claims, 3 Drawing Sheets

FOREIGN PATENT DOCUMENTS

Figure 1:
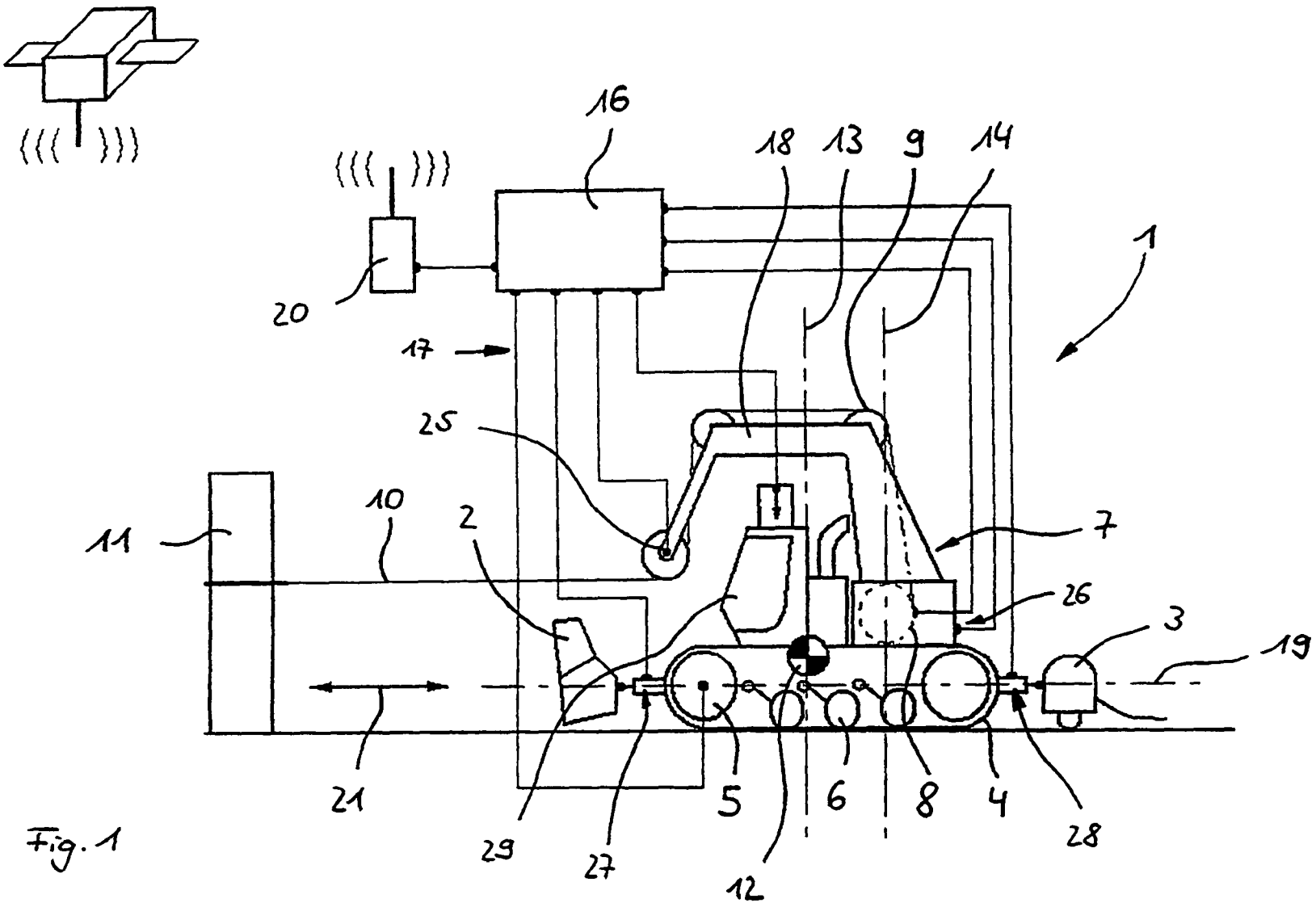

| | | | |
|---|---|---|---|
| DE | 102 61 944 | A1 | 7/2004 |
| EP | 0 719 726 | A1 | 7/1996 |
| EP | 1 118 580 | B1 | 7/2001 |

OTHER PUBLICATIONS

Written Opinion of International Searching Authority (6 pages).

* cited by examiner

PISTE GROOMING VEHICLE WITH CABLE TORQUE COMPENSATION

The invention relates to a piste grooming vehicle with a point of application for cable forces, which point of application is assigned to a cable winch and is arranged at a distance from a yaw axis of the piste grooming vehicle, and to a method for compensating for a cable torque.

A piste grooming vehicle which can be used, in particular, for grooming ski pistes is known from the prior art. The known piste grooming vehicle can be equipped with a cable winch in order to be able to be used even in highly sloping piste regions. DE 102 61 944 A1 describes a piste grooming vehicle which is equipped with a cable winch and in which a chain speed of a driving chain and a cable speed of a traction cable to be wound up on or unwound from a cable winch are determined. A control device is used to match the cable speed to the chain speed of the piste grooming vehicle. A piste grooming vehicle is typically assigned at least one piste grooming apparatus which can be designed, in particular, as a rotary snow plough, clearing shovel or smoothing board. In interaction with the topography of the underlying surface over which the piste grooming vehicle moves, the piste grooming apparatus has a considerable influence on the driving force to be applied by the driving motor of the piste grooming vehicle. The driving force is transmitted to the underlying surface by the driving motor via driving chains, the driving chains determining the position of a yaw axis of the piste grooming vehicle. The yaw axis is oriented at least essentially parallel to a vertical axis of the piste grooming vehicle, ie, when the piste grooming vehicle is positioned on a flat underlying surface, the yaw axis runs perpendicularly with respect to the underlying surface area. The yaw axis is the same axis of rotation about which the piste grooming vehicle rotates if a torque is exerted about a vertical axis of the piste grooming vehicle. The yaw axis is determined essentially by the geometry and arrangement of the driving chains and by the center of gravity of the piste grooming vehicle. The center of gravity is determined, in particular, by the position of the driving motor and the position and positioning of the at least one piste grooming apparatus. In addition, dynamic effects, such as external forces which act on the piste grooming vehicle via the piste grooming apparatus or apparatuses, and/or acceleration and braking operations of the piste grooming apparatus on the level or on a slope are also to be taken into consideration in the determination of the position of the yaw axis.

In a typical construction of a piste grooming vehicle, the yaw axis is at a distance from a point of application of the cable forces which can be applied by the cable winch. The point of application for cable forces is that point on the piste grooming vehicle at which the traction cable, which is acted upon by cable forces, can introduce the cable forces into the piste grooming vehicle at a point connected fixedly to the piste grooming vehicle. In the case of a cable winch which is installed fixedly on the piste grooming vehicle, the point of application for cable forces lies, in particular, on a traction-cable deflecting pulley connected fixedly to the cable winch. In the case of a cable winch which is attached rotatably to the piste grooming vehicle, as is typically used and which is equipped, in particular, with a supporting jib for guiding the traction cable, the point of application for the cable forces can be arranged at an end region of the supporting jib, which region faces away from the cable winch.

Since, during operation of the piste grooming vehicle, the traction cable is fastened to a point which is fixed on the terrain and which is typically arranged centrally over a relatively large piste section to be worked on by the piste grooming vehicle, it cannot be ensured that the cable forces are oriented exclusively in the direction of travel of the piste grooming vehicle. On the contrary, the cable force applied by the cable winch also results in cable force components which are oriented orthogonally with respect to a direction of travel of the piste grooming vehicle and are referred to as transverse forces. The transverse forces depend in respect of their magnitude and their direction essentially on an angle between the direction of travel of the piste grooming vehicle and the orientation of the traction cable from the cable winch on the point fixed on the terrain, and from the cable force in the traction cable. The greater the angle between the direction of travel of the piste grooming vehicle and the traction cable, the greater are the transverse forces which act on the piste grooming vehicle. In addition, in the event of an increased angle between direction of travel and traction cable direction, the cable force applied by the cable winch also has to be increased in order to keep the necessary cable force component in the direction of travel of the piste grooming vehicle at least essentially constant. As a result, an additional increase in the transverse force takes place.

The spatial distance between the point of application for the cable forces and the yaw axis results in a yawing moment, which is caused by the transverse force, about the yaw axis being exerted on the piste grooming vehicle, said yawing moment leading to an undesirable change in direction of the piste grooming vehicle. In order to ensure that the piste grooming vehicle drives essentially straight ahead, an operator has to ensure, by means of counter control measures, i.e. by braking or accelerating a driving chain, that the yawing moment is at least substantially compensated for. This signifies an undesirable additional loading on the operator who is distracted as a result from other piste grooming tasks, making the operation of the piste grooming vehicle unnecessarily strenuous. In addition, the yawing moment results in an unstable driving performance which, possibly during manual compensating for the yawing moment, may be reinforced by oversteering of the piste grooming vehicle leading to the piste grooming quality being impaired.

The object on which the invention is based is to provide a piste grooming vehicle and a method for compensating for a cable torque, said vehicle and method making operation easier and increasing the comfort.

This object is achieved by a piste grooming vehicle of the type mentioned at the beginning, in which at least one control device is provided which is designed to be in operative connection with at least one control means for compensating for at least one cable torque which can be applied by a cable traction force of the cable winch in relation to the yaw axis. In this case, the control device is provided, in particular, as a hydraulic, pneumatic, mechanical, electric or electronic influencing device or as a combination thereof on the piste grooming vehicle and is designed for direct or indirect engagement in energy flows of the piste grooming vehicle. The control device can be provided, in particular, for direct activation of, in particular, hydraulic, pneumatic, mechanical and/or electric energy flows which are output to at least one control means. In addition or alternatively, it may also be provided for engagement in control units of the piste grooming vehicle, which control units control or regulate the energy flows to be output to the control means. The control means is suitable in order to permit an at least partial compensation of the yawing moment, i.e. of the cable torque applied by the cable traction force of the cable winch in relation to the yaw axis.

In a refinement of the invention, the control device is designed for at least essentially automatically compensating for the cable torque (Mq). The effect achieved by the at least partial automated compensation of the yawing moment is that the operator of the piste grooming vehicle can devote greater attention to piste grooming. The at least partially automated compensation of the yawing moment means that the piste grooming vehicle also has a more comfortable driving performance, since rotational movements about the yaw axis can be reduced or minimized, which rotational movements otherwise lead to an unstable driving performance of the piste grooming vehicle.

In a further refinement of the invention, at least one cable angle measuring device is provided, and the control device is designed for processing cable angle signals. A cable angle measuring device permits an automated determination of the angle between the direction of travel of the piste grooming vehicle and the essentially rectilinear orientation of the traction cable with a point fixed on the terrain. From the cable angle signals made available by the cable angle measuring device, the control device can produce an actuating signal for at least one control means by means of which the desired compensation of the yawing moment can be brought about. In a preferred embodiment of the invention, the cable angle measuring device is provided on a supporting jib of the cable winch, in particular at an outlet point of the traction cable from the supporting jib, and thereby permits a particularly advantageous and exact determination of the cable angle.

In a further refinement of the invention, at least one position sensor is provided, and the control device is designed for processing position sensor signals. A position sensor permits, in particular, the determination of a positioning of a piste grooming apparatus or of the cable winch relative to the piste grooming vehicle and, as a result, permits, in particular, a determination of the position of the yaw axis by means of the control device as a function of the positioning of the piste grooming apparatus and/or the cable winch. If a position sensor is attached to the cable winch, the angle between the direction of travel of the piste grooming vehicle and the orientation of the traction cable with the point fixed on the terrain can be determined in a simple manner. For this purpose, during operation, the cable winch is attached in a manner such that it can be pivoted freely in relation to the piste grooming vehicle and, in particular, has a supporting jib for deflecting the traction cable from the cable winch in the direction of the point fixed on the terrain. In the case of a configuration of this type, the angle between direction of travel and orientation of the traction cable can be determined solely via the position sensor attached to the cable winch. The position sensor can be designed, in particular, as a linear displacement measuring device or as an angle sensor and can be based on an electric, electronic, optical, mechanical, pneumatic or hydraulic measuring principle or on a combination thereof.

In a further refinement of the invention, at least one inclination sensor is provided. The inclination sensor can be attached to the piste grooming vehicle in particular in such a manner that it determines an inclination of the piste grooming vehicle about a transverse axis. In this case, the transverse axis is oriented both orthogonally with respect to the vertical axis and with respect to a center longitudinal axis of the vehicle, the center longitudinal axis essentially corresponding to the main direction of travel of the piste grooming vehicle. The inclination sensor permits the determination of an angle between the vertical axis of the piste grooming vehicle and a vertical axis. In interaction with the positioning of the piste grooming apparatuses and the forces acting on the piste grooming apparatuses, the angle determined by the inclination sensor has an effect on the position of the yaw axis of the piste grooming vehicle. The steeper the slope on which the piste grooming apparatus is moving, the greater does the position of the yaw axis deviate from its position when the piste grooming vehicle is positioned horizontally. The control device is designed for processing inclination sensor signals and therefore permits a more exact calculation of the yaw axis of the piste grooming vehicle.

In a further refinement of the invention, a piste grooming apparatus which is attached pivotably in the front or rear region of the piste grooming vehicle is designed as a control means. The piste grooming apparatus, which can be designed in particular as a clearing blade attached on the front side or as a rotary snow plough attached on the rear side, can be adjusted in relation to the piste grooming vehicle typically in the direction of the vertical axis and in the direction of the transverse axis by means of corresponding actuating devices and is activated by the control device or by a control unit of the piste grooming vehicle. The orientation of the piste grooming apparatus relative to the piste grooming vehicle makes it possible for an asymmetrical introduction of force into the piste grooming vehicle to take place, leading to a yawing moment about the yaw axis. Given a suitable orientation of the piste grooming apparatus, in particular about the vertical axis, an at least partial or complete compensation of the cable torque, which is applied by the cable traction force, about the yaw axis is possible. The use of at least one piste grooming apparatus as a control means is particularly advantageous in particular if the cable winch does not have a supporting jib or is arranged in a manner such that it can be rotated freely about the vertical axis during operation of the piste grooming vehicle. In this case, the activation of at least one piste grooming apparatus by means of the control device permits a particularly advantageous compensation for the cable torque.

In a further refinement of the invention, at least one driving unit which is assigned to at least one driving chain is designed as a control means. A driving unit, for example in the form of an electric or hydraulic driving motor, may be assigned to at least one driving chain and permits the transmission of a driving torque to the driving chain via a tumbler wheel. The driving unit may also be designed as a mechanical distributor mechanism, in particular as a differential, with at least one driving chain being assigned a braking device which permits a different distribution of the driving torque to the driving chains. The use of the driving unit as a control means permits a particularly simple compensation of the cable torque about the yaw axis, since only one of the typically two driving chains of the piste grooming vehicle has to be acted upon by a higher driving torque or braking moment.

In a further refinement of the invention, the cable winch is designed as a control means and has an actuating device for carrying out pivoting movements about a cable winch pivot axis and a supporting jib for guiding the cable. An actuating device, which can be designed in particular as an electrically, pneumatically or hydraulically driven actuating motor or actuating cylinder, permits the cable winch, which is equipped with the supporting jib, to be oriented counter to the cable force. This necessitates a powerful actuating device which cannot only pivot the cable winch counter to its deadweight but also is capable of applying the considerable torque, which is caused by the high cable forces and the length of the supporting jib, about the cable winch pivot axis in order to pivot the cable winch to compensate for the yawing moment. The supporting jib of the cable winch can therefore be oriented differently from an essentially rectilinear connection between the piste grooming vehicle and the point which is fixed on the terrain and at which the traction cable is anchored during operation of the piste grooming vehicle. As a result, upon a suitable deflection of the supporting jib of the cable winch about the cable winch pivot axis, a load moment in relation to the cable torque, which is applied by the cable traction force, about the yaw axis can be brought about. An at least partial compensation for said yawing moment is therefore made possible. The compensation for the yawing moment can be undertaken either manually by the operator of the piste grooming vehicle, who activates the actuating device via a hand wheel or an actuating potentiometer, with it being possible for the actuating device to be assigned, in particular, a hydraulic proportional valve. In a preferred embodiment, an automatic compensation of the yawing moment by the cable winch is provided, during which the actuating device is activated by the control device, thereby ensuring the desired relieving of the operator of load.

In this case, the supporting jib which, at an end region facing away from the cable winch, serves as a point of application for cable forces forms a lever arm which permits the cable force to be introduced differently from the cable winch pivot axis. On the contrary, if the supporting jib of the cable winch is deflected counter to the cable force, the point of application of the cable force can be assumed to be in an end region of the supporting jib and can be taken into consideration in the determination of the yawing moment. In a preferred embodiment of the invention, the cable winch is attached rotatably to the piste grooming vehicle via a slewing ring mounted on ball bearings, and the actuating device is designed as a slewing gear drive, in particular as an electric motor or hydraulic motor. The slewing gear drive is designed in a manner such that it can be activated by the control device and acts via a pinion on an at least partially encircling toothing provided on the cable winch.

In a further refinement of the invention, the supporting jib is designed for orientation of the traction cable in such a manner that an extension of a center longitudinal axis of the traction cable can be converged at least with the yaw axis. The supporting jib is mounted together with the cable winch in a rotatable manner on the piste grooming vehicle by means of the actuating device, with it being possible for the point of application of the cable forces to be shifted in the direction of the yaw axis by rotation of the supporting jib. In order to achieve an at least virtually complete compensation for the cable torque, which is caused by the cable traction force, about the yaw axis, the traction cable has to be oriented in relation to the piste grooming vehicle, by pivoting of the cable winch provided with the supporting jib, in such a manner that a center longitudinal axis of the traction cable, which axis extends from the point fixed on the terrain to the point of application for cable forces, intersects the yaw axis of the piste grooming vehicle in a rectilinear extension. During operation of the piste grooming vehicle, a dynamic shifting of the yaw axis can take place. The position of the yaw axis is essentially determined by forces which act on the piste grooming apparatuses, by the position of the piste grooming apparatuses and the inclination of the underlying surface over which the piste grooming vehicle is moving. Since low yawing moments are negligible because of the mass inertia of the piste grooming vehicle, an at least substantial convergence of an extension of the center longitudinal axis of the traction cable with the yaw axis by the shifting of the supporting jib suffices. In order to avoid constant readjustment of the position of the supporting jib, a damping algorithm can be stored in the control device, said algorithm preventing the actuating device from being activated within a predeterminable tolerance range for an angular difference between direction of travel and cable force.

The object on which the invention is based is also achieved by a method for compensating for a cable torque on a piste grooming vehicle, which method has the following steps:

- determining an oblique traction angle between a direction of travel of the piste grooming vehicle and a traction cable direction,
- determining a cable torque, which acts about a vertical axis by means of a cable traction force on the piste grooming vehicle, as a function of a distance between a point of application for cable forces and a yaw axis by means of a control device,
- activating at least one control means for at least partial compensation of the cable torque by means of the control device.

In this case, in a first step, the oblique traction angle, i.e. the angle between the direction of travel of the piste grooming vehicle and the traction cable which runs between the piste grooming vehicle and a point fixed on the terrain is determined, in the case of a cable winch fastened in a freely rotatable manner to the piste grooming vehicle, in particular with the aid of a position sensor provided on the cable winch. Subsequently, a cable torque is calculated, for which purpose, in particular, a cable traction force exerted by the cable winch is determined by a cable traction force sensor. The cable traction force determined is related to a distance between a point of application for cable forces on the piste grooming vehicle and the yaw axis, as a result of which the cable torque occurring in the form of a yawing moment can be calculated. When the cable torque is known, the control device can then activate at least one control means, in particular a piste grooming apparatus or a driving device, for at least partially compensating for the cable torque.

In a further refinement, the oblique traction angle is determined from the signals of the position sensor attached to the cable winch and from signals of a cable angle measuring device. This method step is required if the cable winch is not fastened in a freely rotatable manner to the piste grooming vehicle but rather is held in a predeterminable position by means of an actuating device or is connected fixedly to the piste grooming vehicle. In these situations, the signal of the position sensor provided on the cable winch is not sufficient in order to determine the oblique traction angle. Rather, the oblique traction angle can be determined by a combination of the signal of the position sensor with a signal of a cable angle sensor. In this case, the cable angle sensor determines the orientation of the traction cable in relation to the supporting jib of the cable winch while the position sensor determines the orientation of the supporting jib in relation to the direction of travel of the piste grooming vehicle. In addition, the signal of the position sensor can be used to determine the position of the point of application for cable forces, which point of application is arranged in the end region of the supporting jib and which can be shifted essentially on a circular path about a pivot axis of the cable winch. The control device is provided with a calculating unit which determines the oblique traction angle between traction cable and piste grooming vehicle and the distance between the point of application for cable forces and the yaw axis from the signals of the position sensor and of the cable angle measuring device and therefore calculates the magnitude and the direction of the yawing moment about the yaw axis.

In a further refinement of the invention, it is provided that at least one signal of a position sensor of a piste grooming apparatus is incorporated in the control device in order to determine a position of the yaw axis. The piste grooming apparatuses, for example a clearing blade attached on the front side or a rotary snow plough attached on the rear side, influence, by virtue of their considerable deadweight, the position of the center of gravity of the piste grooming vehicle and determine the orientation and position of the yaw axis at the same time. Taking the position of the at least one piste grooming apparatus into consideration therefore makes it possible to more precisely determine the position of the yaw axis. For this purpose, a signal of a position sensor which is assigned to the piste grooming apparatus is conducted to the control device where it is used to calculate the yaw axis. In a preferred embodiment of the invention, force sensors can additionally be provided on at least one piste grooming apparatus, the force sensors determining the forces to which the piste grooming apparatus is subjected and therefore making it possible to additionally precisely state the dynamic position of the yaw axis.

In a further refinement of the invention, at least one signal of an inclination sensor is incorporated in the control device in order to determine the position of the yaw axis. The inclination sensor permits the determination of an angle between the vertical axis of the piste grooming vehicle and a vertical axis oriented perpendicularly, i.e. in particular from the center of gravity of the piste grooming vehicle to the center point of the earth, and thereby permits the position of the yaw axis to be more precisely determined. The position of the yaw axis can be influenced, in particular, by a dynamic shifting of the center of gravity, which is brought about by the orientation of the piste grooming vehicle on a slope or a gradient in the terrain, by the positioning of the piste grooming apparatuses and by forces which act on the piste grooming apparatuses. By incorporating the signal of the inclination angle sensor, a more exact determination of the position of the yaw axis can be undertaken, in particular in real time.

In a further refinement of the invention, at least one piste grooming apparatus which is attached pivotably in the front region or in the rear region of the piste grooming vehicle is used as a control means for producing a load moment in relation to the cable winch moment. This can take place, in particular, by pivoting the piste grooming apparatus or piste grooming apparatuses about the vertical axis of the piste grooming vehicle, as a result of which an effect as with a ship's rudder arises. The pivoting causes an asymmetrical distribution of force to the piste grooming apparatus, leading to a torque about the yaw axis. If the piste grooming apparatus is suitably pivoted, an at least partial compensation of the cable winch moment can therefore be produced in a simple manner, in particular if the cable winch is attached in a loosely rotatable manner.

In a further refinement of the invention, the supporting jib provided on the cable winch is used in operative connection with an actuating means as a control means for producing a load moment in relation to the cable winch moment. In this case, the actuating means is assigned to the cable winch arranged rotatably on the piste grooming vehicle and permits a pivoting of the cable winch and of the supporting jib attached thereto, if appropriate, in such a manner that an extension of the center axis of the traction cable is converged with the yaw axis. This convergence causes a load moment about the yaw axis, the load moment leading to an at least partial compensation of the yawing moment caused by the cable traction force. If the supporting jib can be shifted in such a manner that the extension of the center axis of the traction cable intersects the yaw axis, the yawing moment and the load moment are neutralized and the piste grooming vehicle is torque-free about the vertical axis or yaw axis in respect of the cable traction forces.

In a further refinement of the invention, at least one control means is used for compensating for a drift caused by the cable force. A compensation of the yawing moment which is exerted on the piste grooming vehicle by the cable traction force may lead, in particular when a supporting jib of the cable winch is used to produce a load moment, to an increased cable force. The cable force, for its part, has a force component orthogonal with respect to the direction of travel of the piste grooming vehicle. Said force component leads to a lateral offset of the piste grooming vehicle during a forward or reversing movement, with the lateral force component changing dynamically during the forward and reversing movement of the piste grooming vehicle. In order to make it possible for the operator of the piste grooming vehicle nevertheless to rectilinearly finish the piste section to be groomed, at least one control means, in particular a piste grooming apparatus and/or a driving unit of the piste grooming vehicle, is used in order to counteract said lateral offset movement and therefore ensure rectilinear progress of the piste grooming vehicle.

In a further refinement of the invention, the control device activates the at least one control means in such a manner that a convergence of a center longitudinal axis of a traction cable with a yaw axis of the piste grooming vehicle takes place. The greater the convergence of the center longitudinal axis of the traction cable with the yaw axis of the piste grooming vehicle, the smaller is the yawing moment exerted on the piste grooming vehicle by the cable traction forces. In view of the inertia of the piste grooming vehicle, complete neutralization of the yawing moment by the load moment appears not to be necessary.

In a further refinement of the invention, the control device activates the at least one control means in such a manner that a predeterminable drift value is maintained. Since compensation for a drift requires the piste grooming vehicle to be oriented at an angle relative to the effective direction of travel, loadings which may lead to increased wear occur on the piste grooming vehicle as a result. In order to keep the wear to an acceptable level, the control device can be used to predetermine a drift value which constitutes an advantageous compromise between the wear, on the one hand, and a drift which occurs, on the other hand. The predeterminable drift value may be set in particular by the operator, with it being possible for a maximum or minimum drift value which the operator may not exceed or fall short of to be stored in the control device.

Figure 2:
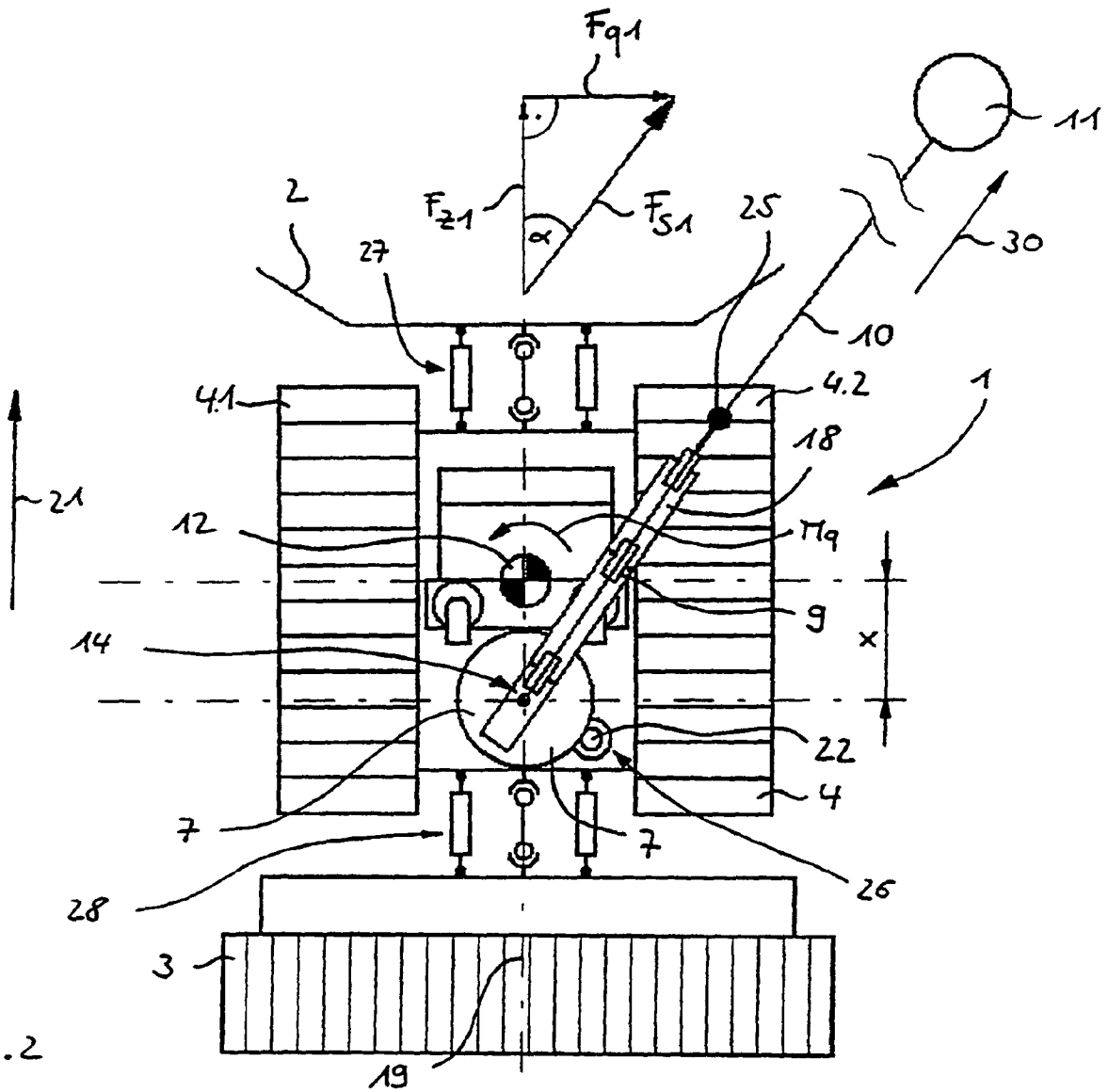
Figure 3:
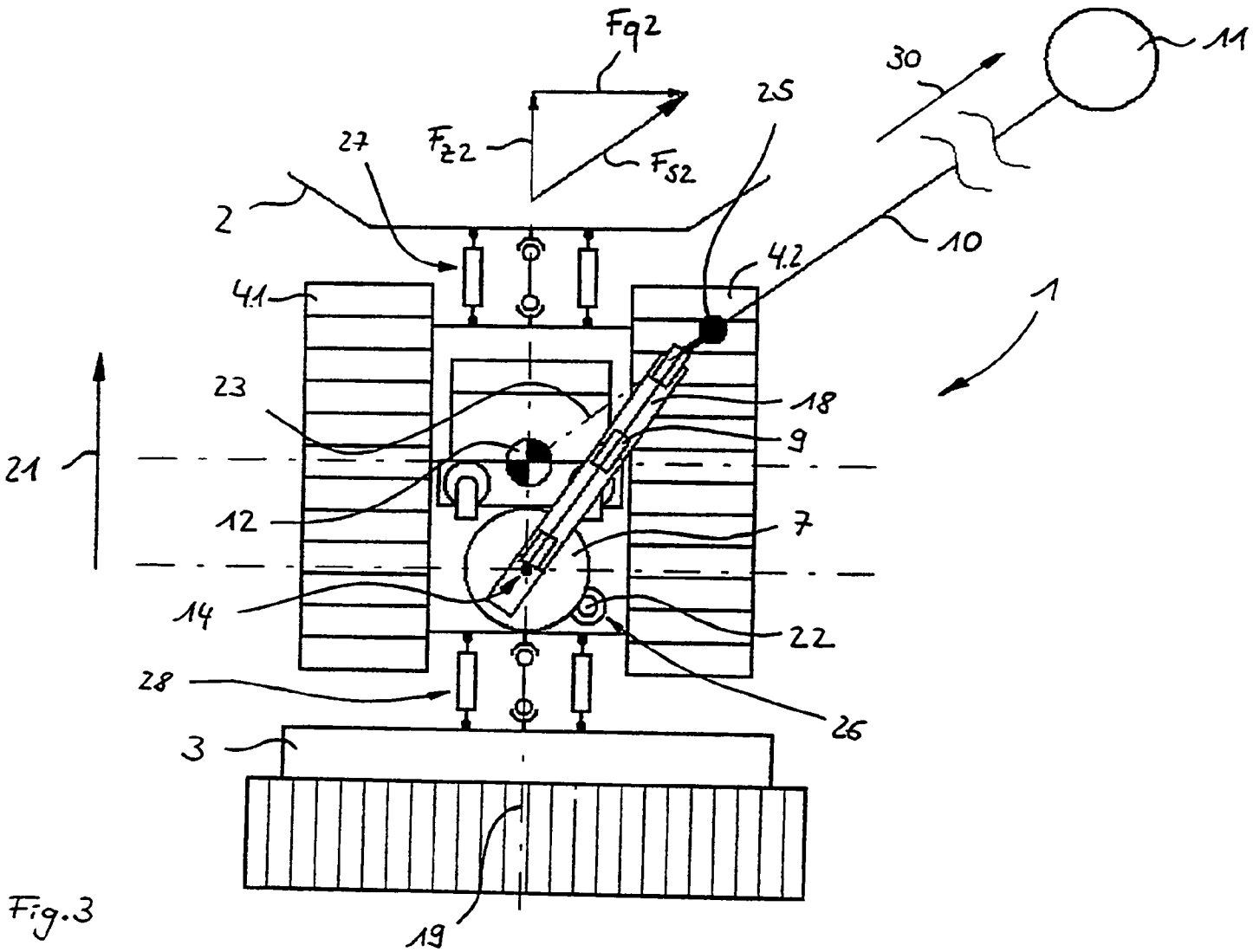

Other advantages and features of the invention emerge from the claims and from the description below of a preferred exemplary embodiment of the invention, which is illustrated with reference to the drawings, in which:

FIG. 1 shows, in a side view, a piste grooming vehicle with a cable winch and control device, FIG. 2 shows, in a plan view, the piste grooming vehicle according to FIG. 1 with a supporting jib oriented to a point fixed on the terrain and with a freely rotatable cable winch, and FIG. 3 shows, in a plan view, the piste grooming vehicle according to FIG. 1 with a pivoted supporting jib of the cable winch.

A piste grooming vehicle 1, which is designed as a track laying vehicle driven by an internal combustion engine (not illustrated), has a piste grooming apparatus designed as a clearing blade 2 in a front region and a piste grooming apparatus designed as a rotary snow plough 3 in a rear region. The internal combustion engine and a driving unit (not illustrated)

are mounted on a frame structure (not illustrated specifically) of the piste grooming vehicle. The driving unit is provided for a drive of a tumbler wheel 5 which is provided for driving a driving chain 4. The driving chain 4 is supported by supporting wheels 6 and permits the transmission of driving forces even on a relatively loose underlying surface, such as, for example, snow or sand. The base frame is also assigned a cable winch 7 which can be driven by the internal combustion engine, in particular via a hydraulic motor, and which can unwind a traction cable 10 from a drum-shaped winder 8 and can wind it up thereon. The traction cable 10 is guided by the winder 8 via deflecting pulleys 9 along a supporting jib 18 to in front of the driver's cab 29 of the piste grooming vehicle 1 and extends from there as far as a picket 11 which is anchored in a manner fixed on the terrain and which is designed for absorbing cable forces.

A center of gravity 12 of the piste grooming vehicle 1 is substantially influenced by the weight of the internal combustion engine, the weight of the cable winch and the weight of the piste grooming apparatuses 2, 3 and is shown by way of example below the driver's cab 29. A yaw axis 13, the position of which is dependent on the positioning of the piste grooming apparatuses 2, 3, on the forces which act on the piste grooming apparatuses 2, 3 and on the inclination of the underlying surface along which the piste grooming apparatus 1 moves, is likewise shown by way of example. The yaw axis is arranged in a manner such that it can be displaced by means of said influences along a center longitudinal axis 19 and, in FIG. 1, runs by way of example through the center of gravity 12. The cable winch 7, which is attached pivotably to the base frame, has a pivot axis 14 which is arranged at a distance from the yaw axis 13.

A control device 16 which is illustrated outside the piste grooming apparatus 1 for the purpose of clarification, but in practice is integrated in the piste grooming apparatus 1 is provided on the piste grooming apparatus 1 according to FIG. 1. In FIGS. 2 and 3, the illustration of the control device has been omitted for reasons of simplification. The control device 16 is connected via control lines 17 to the piste grooming apparatuses 2 and 3, the cable winch 7 and sensor means, in particular the position sensors 26, 27, 28 attached to the clearing blade 2, the rotary snow plough 3 and the cable winch 7. The control lines 17 permit the transmission of energy flows to energy consumers of the piste grooming apparatuses 2 and 3 and of the cable winch 7 and also the transmission of sensor signals of the position sensors 26, 27, 28 to the control device 16. The control device 16 is assigned, by way of example, an inclination sensor 15 which is attached to the piste grooming vehicle 1. The inclination sensor 15 permits determination of an angle of inclination between a vertical axis of the piste grooming vehicle 1, as indicated by the yaw axis 13, and a vertical axis which extends, for example, from the center of gravity 12 as far as a center point of the earth. A cable angle sensor 25 (illustrated schematically) is attached in an end region of the supporting jib 18, which end region faces away from the cable winch 7, said cable angle sensor being provided to determine a positioning of the cable in relation to the supporting jib 18, as illustrated in more detail in FIG. 3. The cable angle sensor 25 is connected to the control device 16 via a control line 17. The control device 16 is also assigned a satellite receiver 20 which is designed for receiving position signals of one or more position fixing satellites and which permits an exact determination of the position of the piste grooming vehicle even in impossible terrain. With the aid of the satellite receiver 20, it is possible, in the control device 16, with further sensor data being incorporated, in particular of position sensors 26, 27, 28 of the cable winch 7 or of the piste grooming apparatuses 2, 3 and/or of the cable angle sensor 25, for a relationship between the forces and moments acting on the piste grooming vehicle 1 and the surface worked on by the piste grooming vehicle 1 to be calculated and, furthermore, for an optimization of the activation of the piste grooming apparatuses 2, 3, of the cable winch 7 and/or of the driving unit to be undertaken.

In order to carry out piste grooming work, the piste grooming vehicle 1 moves predominantly in the main direction of travel 21, with it being possible for snow, in particular, to be displaced by the piste grooming vehicle 1, by means of the clearing blade 2, while the underlying surface traveled over by the piste grooming vehicle 1 can be prepared and smoothed by the rotary snow plough 3. The cable winch 7 is provided for effective grooming of the pistes, even in steep slope positions, the cable winch permitting a transmission of cable forces to the piste grooming vehicle 1 via the traction cable 10, which is attached to the picket 11, and therefore assisting the driving forces, which are applied by the driving chains 4, for propulsion of the piste grooming vehicle.

In the illustration according to FIG. 2, the traction cable 10 is arranged rectilinearly between the picket 11 and the pivot axis 14 of the cable winch 7, and therefore a traction cable direction 30 is identical with the orientation of the supporting jib 18. The cable winch 7 is arranged in a freely rotatable manner in relation to the piste grooming vehicle 1 such that the rectilinear orientation of the traction cable 10 is ensured during a forward or reversing movement of the piste grooming vehicle 1 relative to the picket 11. The cable force Fs1 which is applied by the cable winch 7 and is illustrated schematically in FIG. 2 can be divided into a traction force Fz1, which extends in the direction of travel 21 of the piste grooming vehicle 1, and into a transverse force Fq1, which acts orthogonally with respect to the traction force Fz1. In the case of a freely rotatable cable winch, the transverse force Fq1 acts on the winder 8 of the cable winch 7 such that the pivot axis 14 roughly constitutes the point of application for the cable force. This point of application for the cable force is spaced apart from the yaw axis, which is guided, by way of example, through the center of gravity 12 and is not illustrated in FIG. 2, at a distance x. The transverse force Fq1 acting in the point of application for the cable force causes a yawing moment Mq1 on the piste grooming vehicle 1 via the lever arm x.

The yawing moment Mq1 can be at least partially compensated for by means of an acceleration of the right driving chain 4.1, by means of a braking of the left driving chain 4.2 or by means of a pivoting of the clearing blade 2 or of the rotary snow plough 3. This compensation is brought about by means of reaction forces which the driving chains 4.1, 4.2 and the piste grooming apparatuses 2 and 3 exert on the piste grooming vehicle and which act at a distance from the yaw axis and therefore can exert load moments in relation to the yawing moment Mq1.

In order to relieve the load on an operator of the piste grooming vehicle 1, the yawing moment Mq1 is automatically compensated for by the control device (not illustrated in FIG. 2) by the oblique traction angle $\alpha$ between the traction cable 10 and the main direction of travel 21 of the piste grooming vehicle 1 being determined by the control device 16 and a corresponding load moment being applied by activation of at least one control means, i.e. at least one driving chain 4.1, 4.2 and/or of the clearing blade 2 and/or of the rotary snow plough 3.

In the case of the configuration, illustrated in FIG. 3, of the piste grooming vehicle 1, it is provided that the cable winch 7 with the supporting jib 18 attached thereto is adjusted from the configuration illustrated in FIG. 2 via a slewing gear drive 22 which is designed as a hydraulic motor and engages by means of a pinion with a toothing (not illustrated specifically) provided in an encircling manner on the cable winch 7. In order to adjust the cable winch 7 counter to the cable force Fs2, the slewing gear drive 22 has to exert a torque on the Cable winch 7, which torque is opposed by the torque exerted by the transverse force Fq. There is therefore a difference between the orientation of the supporting jib 18 and the cable traction direction 30. As soon as an extension 23 of the center axis of the traction cable 10 intersects the yaw axis guided, by way of example, through the center of gravity 12, there is an equilibrium of moments about the yaw axis, and therefore the piste grooming vehicle 1 is torque-free about the yaw axis in respect of the cable traction force Fs2. As illustrated in FIG. 3, it can be seen that, in contrast to the illustration of FIG. 2, the transverse force Fq2 is greater than the traction force Fz2, which is expressed in an increased drift of the piste grooming vehicle 1 in the direction of the traction cable 10.

The yawing moment can be compensated for by a manual influencing of the slewing gear drive 22 of the cable winch 7; for this purpose the operator has to orient the cable winch 7 in such a manner that an extension of the extension 23 of the center axis of the traction cable 10 converges with the yaw axis. As an alternative or in addition, the control device (not illustrated in FIG. 3) can therefore be programmed in such a manner that the drift movement orthogonally with respect to the direction of travel 21, which drift movement is caused by the transverse force Fq2, can be at least partially compensated for in particular by means of control means, such as the driving chains 4.1, 4.2, the clearing blade and/or the rotary snow plough 3. An economical and low-wear compensation of the yawing moment can therefore be brought about without the action of an operator of the piste grooming vehicle, and therefore an improved operation of the piste grooming vehicle 1 is made possible.

In the case of one configuration (not illustrated) of the piste grooming vehicle 1, the supporting jib 18 of the cable winch 7 is oriented by means of the slewing gear drive 22 in such a manner that the cable force relative to the main direction of travel 21 is located in an angular range between the angle $\alpha$ according to FIG. 2 and the angle $\beta$ according to FIG. 3 and therefore only a partial compensation of the yawing moment takes place by means of the cable winch 7. A further torque directed counter to the yawing moment is applied in particular by means of the clearing blade 2, the rotary snow plough 3 and/or with the driving chain 4, and therefore the piste grooming vehicle 1 is oriented with its center longitudinal axis 19 essentially parallel to the main direction of travel 21.

One embodiment (not illustrated) of the invention provides a damping apparatus which is designed for damping cable force fluctuations. The damping apparatus can be brought about by means of an elastic or pivotably mounted supporting jib section which, upon a rapid increase in the cable force, can be deflected out of an inoperative position and therefore prevents an undamped action of the increase on the piste grooming vehicle.

The invention claimed is:

1. A piste grooming vehicle with a point of application for cable forces, the point of application being assigned to a cable winch and being arranged at a distance from a yaw axis of the piste grooming vehicle, wherein at least one control device is operatively connected to at least one control apparatus that compensates for at least one cable torque applied by a cable traction force of the cable winch in relation to the yaw axis.

2. The piste grooming vehicle as claimed in claim 1, wherein the at least one control device at least automatically compensates for the at least one cable torque.

3. The piste grooming vehicle as claimed in claim 2, wherein at least one cable angle measuring device is provided and the at least one control device is designed for processing cable angle signals.

4. The piste grooming vehicle as claimed in claim 2, wherein at least one position sensor is provided and the at least one control device is designed for processing position sensor signals.

5. The piste grooming vehicle as claimed in claim 2, wherein at least one inclination sensor is provided, and the at least one control device is designed for processing inclination sensor signals.

6. The piste grooming vehicle as claimed in claim 1, wherein the at least one control apparatus comprises a piste grooming apparatus attached pivotably in a front or rear region of the piste grooming vehicle.

7. The piste grooming vehicle as claimed in claim 1, wherein the at least one control apparatus comprises at least one driving unit assigned to at least one driving chain.

8. The piste grooming vehicle as claimed in claim 1, wherein the at least one control apparatus comprises the cable winch, the cable winch having an actuating device for carrying out lifting movements about a cable winch axis and a supporting jib for guiding a cable.

9. The piste grooming vehicle as claimed in claim 8, wherein the supporting jib is designed for orienting the cable in such a manner that an extension of a longitudinal center axis of the cable can be converged at least with the yaw axis.

10. A method for compensating for a cable torque on a piste grooming vehicle, with the following steps: determining an oblique traction angle between a direction of travel of the piste grooming vehicle and a traction cable direction, determining a cable torque, which acts about a vertical axis by a cable traction force on the piste grooming vehicle, as a function of a distance between a point of engagement for cable forces and a yaw axis by a control device, and activating at least one control apparatus to at least partially compensate for the cable torque with the control device.

11. The method as claimed in claim 10, wherein the oblique traction angle is determined from signals of a position sensor attached to a cable winch and from signals of a cable angle measuring device.

12. The method as claimed in claim 10, further including determining a position of the yaw axis from at least one signal of a position sensor of the piste grooming vehicle incorporated in the control device.

13. The method as claimed in claim 10, further including determining a position of the yaw axis from at least one signal of an inclination sensor incorporated in the control device.

14. The method as claimed in claim 10, wherein the at least one control apparatus comprises at least one piste grooming apparatus attached pivotably in a front region or in a rear region of the piste grooming vehicle and the method further includes producing a load moment in relation to the cable torque with the at least one piste grooming apparatus.

15. The method as claimed in claim 10, wherein the at least one control apparatus comprises a supporting jib provided on a cable winch used in operative connection with an actuator and the method further includes producing a load moment in relation to the cable torque with the supporting jib.

16. The method as claimed in claim 10, further including compensating for a drift caused by the cable force with the at least one control apparatus.

17. The method as claimed in claim 10, further including activating the at least one control apparatus with the control device to converge a center axis of a traction cable with the yaw axis of the piste grooming vehicle.

18. The method as claimed in claim 17, further including activating the at least one control apparatus with the control device to maintain a predeterminable drift value.

19. A piste grooming vehicle comprising:

a cable winch having a cable applying a cable traction force to the cable winch, the cable winch having a center point of application, wherein forces from the cable transmitted to the cable winch are centered at the center point of application;

a center of gravity with a vertical yaw axis passing through the center of gravity;

a vertical line passing through the center point of application, the vertical line and the vertical yaw axis being spaced apart;

at least one cable torque being applied about the vertical yaw axis because of the cable traction force being applied to the cable winch;

at least one control mechanism applying a control force to the piste grooming vehicle;

at least one compensating torque being applied about the vertical yaw axis because of the control force being applied to the piste grooming vehicle; and at least one controller operatively connected to the at least one control mechanism providing the at least one compensating torque to the center of gravity for counteracting the at least one cable torque, with the at least one compensating torque having a compensating direction opposite to a cable direction of the at least one cable torque.

20. A method for compensating for the at least one cable torque on the piste grooming vehicle as claimed in claim 19, comprising:

determining the at least one cable torque as a function of a distance between the center point of application and the vertical yaw axis with the at least one controller; and activating the at least one control mechanism with the at least one controller to provide the at least one compensating torque to at least partially compensate for the at least one cable torque.

* * * * *